United States Patent [19]

Dien

[11] 4,164,969

[45] Aug. 21, 1979

[54] GOLF CLUB HEAD COVERS IMPROVEMENT

[76] Inventor: Sam Dien, 156 Rockwood Pl., Englewood, N.J. 07613

[21] Appl. No.: 928,778

[22] Filed: Jul. 28, 1978

Related U.S. Application Data

[63] Continuation of Ser. No. 819,179, Jul. 26, 1977, abandoned.

[51] Int. Cl.[2] ..... A63B 57/00

[52] U.S. Cl. ..... 150/1.5 R; 150/52 G

[58] Field of Search ..... 150/1.5 R, 1.5 B, 1.5 C, 150/52 G

[56] References Cited

U.S. PATENT DOCUMENTS 3,055,409 9/1962 Latina ..... 150/52 G 3,128,812 4/1964 Scheurer ..... 150/52 G X

FOREIGN PATENT DOCUMENTS 974912 11/1964 United Kingdom ..... 150/52 G

*Primary Examiner*—Donald F. Norton

*Attorney, Agent, or Firm*—Hopgood, Calimafde, Kalil, Blaustein & Lieberman

[57] ABSTRACT

A cover for the head of a golf club includes a portion made of Velcro material. A mating portion of Velcro material may be included either on another of the golf club covers or on a strip or belt attached to the golf bag in which the clubs are carried. In one embodiment of the invention, the Velcro material on the golf club cover is arranged in the form of a number which identifies the golf club over which the cover is placed.

4 Claims, 6 Drawing Figures

GOLF CLUB HEAD COVERS IMPROVEMENT

This is a continuation of Ser. No. 819,179, filed July 26, 1977, now abandoned.

The present invention relates generally to golf equipment and, more particularly, to an improved cover for the head of a golf club.

It is common for a golfer to place a protective cover, such as one made of a plastic or vinyl material, over the heads of certain of the golf clubs that he or she uses when playing golf. The covers are typically placed over the heads of the woods to protect the wooden heads of these clubs and, if desired, an additional cover may be placed over the head of the putter.

When the player wishes to use one of the covered clubs, he or she removes the cover from the club, removes the club from the golf bag and uses the club, replaces the club in the bag, and then replaces the previously removed cover over the club head. The major problem that has been experienced in the use of these club head covers is that the player, after removing the cover from the club, may drop it on the course and then forget and lose the cover. Or else, the player may belatedly remember leaving the cover at an earlier hole on the course and be forced to return to a previously played hole to recover the misplaced cover. This impedes the rate of play and causes considerable inconvenience and annoyance to other players on the course, as well as to the player who has to return to a previously played hole to recover the dropped cover.

In order to reduce the inconvenience and cost of lost or misplaced golf club covers, a product is available to fasten the covers at their upper ends to a flexible attachment strip which may be made of rawhide, leather, or the like. When one of the covers is removed from the head of the club then being played, it remains fastened to the strip and thus to the other covers which are in place over the heads of other golf clubs in the golf bag.

The difficulty with this arrangement is that during play the attachment strip often becomes tangled, and it often becomes difficult and annoying for the player to untangle the strip to enable him to remove the cover from the club he wishes to play. To overcome this inconvenience, players will frequently detach the strip from the covers rather than go through the inconvenience and nuisance of untangling the attachment. The cover is then again subject to loss or being misplaced. In addition, the loop on the cover to which the strip is fastened may be pulled off the cover as a result of the player's pulling on the cover to remove the cover from the club head.

Thus, the proposed solution to the loss and misplacing of golf club covers often results in the player's defeating the purpose for which it was intended, that is, the prevention of the loss of the covers, and the slowing down of play to reclaim a cover that was removed from the club and dropped to the ground at a previously played hole on the course.

It is, therefore, an object of the present invention to provide a cover for a golf club head that prevents the loss or misplacement of the cover during play.

It is a further object of the invention to provide an improved golf club cover which may be readily, conveniently, and securely attached to either the golf bag or to another cover, and which can then be replaced over the club after the club is returned to the golf bag.

In accordance with the present invention the golf club cover is provided with a portion of Velcro material. A portion of mating Velcro material is provided on at least one of the other covers in the set, or else on an attachment carried by the golf bag. When a cover is removed from the club to permit that club to be played, the cover is attached by its Velcro material onto a cover not being used that contains a portion of mating Velcro material or onto the mating Velcro attachment provided on the golf bag. The attaching operation, which securely retains the cover in place, and the subsequent removal of the cover from its attachment to place it on the club, may be done in a remarkably short time and reliably prevents the loss of the cover.

In another aspect of the invention, the Velcro material on the cover can be arranged in the form of a number which identifies the golf club over which the cover is placed when the club is not in use.

To the accomplishment of the above and to other objects as may hereinafter appear, the present invention relates to an improved golf club head cover substantially as defined in the appended claims and as described in the following specification of several embodiments thereof as considered with the accompanying drawing in which:

Figure 5:
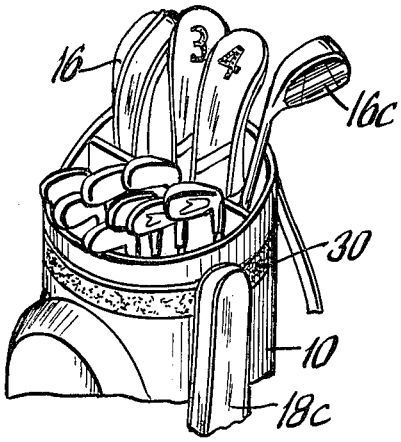
Figure 6:
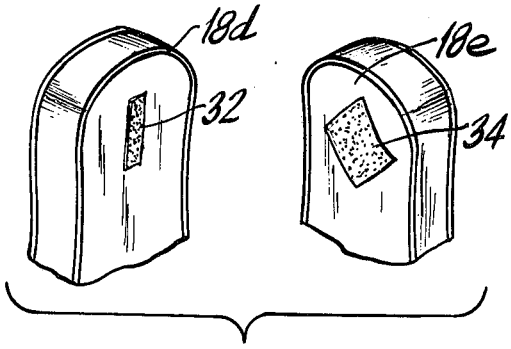

FIG. 5 is a perspective view illustrating an alternate embodiment of the invention in which the Velcro material that mates with that on the club head covers is provided on a ring that is disposed about the upper periphery of the golf bag; and FIG. 6 illustrates in perspective the upper portions of two golf club head covers according to another embodiment of the invention which respectively carry mating Velcro materials.

Figure 1:
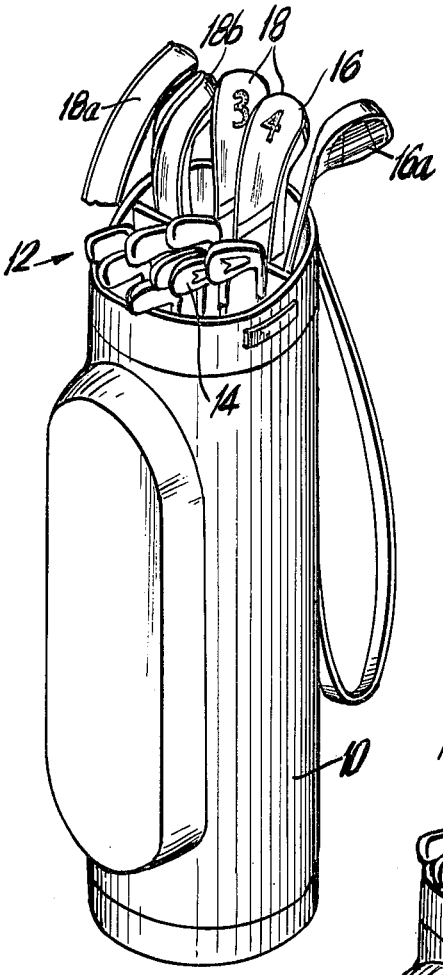
FIG. 1 is a perspective of a golf bag containing a set of golf clubs, some of which have the golf club head cover of the invention carried thereon.

FIG. 1 illustrates a conventional golf bag 10 which carries therein a plurality of covered golf clubs designated 2. As is conventional, the set of clubs includes a number of irons collectively designated 14 and a smaller number of woods collectively designated 16. As shown in FIG. 1, each of the woods are covered with the golf club covers 18 of the invention. In addition, if desired, the putter may also be provided with a cover, although as is typical no cover is provided for the remainder of the irons.

Each of the covers includes an enclosure portion, which can be made of any suitable protective material such as a vinyl plastic. When the player wishes to play one of the woods or the putter, he or she must first remove the cover from the club, as shown in FIG. 1, in which cover **18*a* has been removed from club 16*a***.

The club head cover of the invention, after it has been removed from the club being played, can be reliably and quickly attached to either another cover, as shown by cover 18*b* in FIG. 1, or, as in a later embodiment of the invention, to an additional retaining member carried on or secured to the golf bag.

Figure 2:
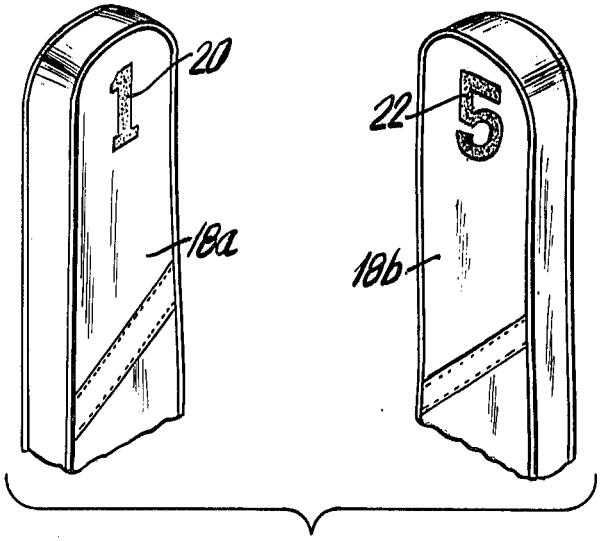
FIG. 2 illustrates two club head covers of the invention which carry respective mating portions of Velcro material.

To this end, as shown more clearly in FIG. 2, the covers 18 each have a portion of Velcro material attached thereon. In the embodiment of the invention shown in FIG. 2, each cover but one includes male (or female) Velcro material as shown at 20 and the remaining cover, which would typically be placed over the No. 5 wood, contains a portion of female (or male) Velcro material at 22. In this embodiment, the male and female Velcro materials 20, 22 are arranged in the form of the numbers, usually 1 to 5 for the woods, which identify the golf clubs associated with these covers. Thus, in FIG. 2, the cover 18*a* would cover the No. 1 wood, whereas the cover 18*b* would cover the rarely used No. 5 wood. If a cover were placed over the putter, that cover would have a portion of Velcro material shaped in the form of the letter "P".

In use, the surface of the removed club head cover is slapped against the surface of the cover of the No. 5 wood which remains in the bag to cause the male and female mating portions of the Velcro material on these two covers to releasably adhere to one another, thereby securely but releasably attaching the removed club head cover to the cover that is over a club still contained in the bag, normally the No. 5 wood. When the No. 5 wood is used, its cover containing the female Velcro material 22 is attached to any of the other covers for the woods, all of which carry portions 20 of male Velcro material.

Figure 3:
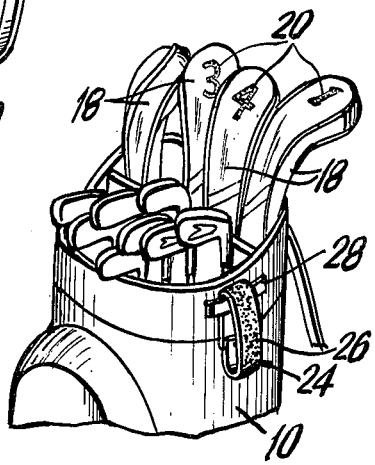
FIG. 3 is a perspective view of an embodiment of the invention in which a portion of Velcro material that is to mate with the Velcro material contained in the club head covers is provided on a loop carried by the golf club bag.
Figure 4:
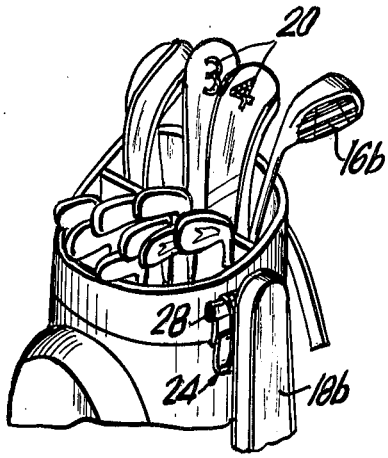
FIG. 4 is a perspective view of the upper portion of a golf bag shown in FIG. 3 showing one of the club head covers of the invention removed from its associated club and attached to the loop of Velcro material carried by the golf bag.

In the embodiment of the invention illustrated in FIGS. 3 and 4, the covers 18 each contain portions of male (or female) Velcro material 20. As in the previously described embodiment, the Velcro material 20 is in the form of the club-identifying numbers. A snap ring 24 which contains mating Velcro material 26 about its outer surface is secured to the golf bag 10 by being passed around a strip 28 formed at the upper portion of the golf bag 10.

As shown in FIG. 4, a cover 18*b* that has been removed from golf club 16*b* over which it is normally placed, is slapped against the snap ring 24 so that the mating Velcro materials on the cover 18*b* and the snap ring adhere to one another, thereby securely but releasably securing the removed cover 18*b* to the golf bag. After the club 16*b* has been used by the player, the cover 18*b* can be removed from the ring 24 simply by pulling the cover from the ring. The cover is then, of course, placed over the club which is also returned to the golf bag.

In the embodiment of the invention shown in FIG. 5, the free golf club cover 18*c* that has been removed from club 16*c* is attached to a strip 30 of mating Velcro material which is attached around the entire periphery of the upper portion of the golf bag 10. Strip 30 contains Velcro material which mates and releasably attaches to the Velcro material attached to the golf club cover as above.

The embodiment of the invention illustrated in FIG. 6 is similar to the previously described embodiment of FIG. 2 in that mating Velcro material is provided on the golf club covers themselves. In this embodiment, the left-hand cover 18*d* contains a strip 32 of male-type Velcro material and the mating right-hand cover 18*e* carries thereon a diamond-shaped or square portion of female-type Velcro material 34. Of course, the male and female types of Velcro materials may be reversed. When one of these covers is slapped onto the other, the two covers releasably but securely adhere to each other. The covers can be readily pulled apart to allow the free cover to be replaced on the golf club from which it was previously removed.

It will be appreciated that the present invention has provided an improved golf club head cover that permits the cover to be removed from the club to enable the player to use the club and then to reliably and quickly attach the removed cover to a convenient location on the golf bag so to prevent the loss of the cover. The cover is easy to secure and to remove from its point of attachment, and avoids all of the difficulties experienced in prior attempts to prevent the loss of golf club covers.

It will also be appreciated that modifications and variations may be made in the several embodiments of the invention as herein above described without departing from the spirit and scope of the invention.

What is claimed is:

1. A group of golf club covers for use in respectively covering a corresponding plurality of clubs each of which is identified by a different numeral and which are to be carried in a golf bag when the clubs are not in use, each of said covers comprising an enclosure for placement over the head of the associated golf club, and a first portion of Velcro material secured to the outer surface of each of said enclosures, a second portion of mating Velcro material being carried by one of an additional cover adapted to be carried by another of the golf clubs and a member secured to the golf bag, said first portion of Velcro material on one of said covers, when said one cover is removed from its associated club when the latter is in use, being capable of being releasably attached to said second portion of mating Velcro material, said first portion of mating Velcro material on each of said covers being formed in the shape of a different number respectively corresponding to the identifying number of the associated one of the golf clubs over which said cover is intended to be placed, when that club is not in use.

2. The group of covers of claim 1, in which said member comprises a ring secured to the golf bag, said second portion of mating Velcro material being provided at about at least a portion of the periphery of said ring.

3. The group of covers of claim 1, in which said second portion of mating Velcro material is attached to the outer surface of an additional cover normally carried by an additional club carried in the golf bag.

4. The group of covers of claim 1, in which said member comprises a strip of said mating Velcro material attached to at least a portion of the outer periphery of the golf bag.

* * * * *